US009341312B2

(12) United States Patent
Lamiable et al.

(10) Patent No.: US 9,341,312 B2
(45) Date of Patent: May 17, 2016

(54) GAS CYLINDER WITH HAND WHEEL FOR ACTUATING A RESIDUAL PRESSURE VALVE AND A SHUT-OFF VALVE

(71) Applicants: Morgan Lamiable, Metzervisse (FR); Adrien Zoda, Zoufftgen (FR); Jean-Claude Schmitz, Heisdorf (LU)

(72) Inventors: Morgan Lamiable, Metzervisse (FR); Adrien Zoda, Zoufftgen (FR); Jean-Claude Schmitz, Heisdorf (LU)

(73) Assignee: Luxembourg Patent Company S.A., Luxembourg (LU)

( * ) Notice: Subject to any disclaimer, the term of this patent is extended or adjusted under 35 U.S.C. 154(b) by 72 days.

(21) Appl. No.: 14/358,584

(22) PCT Filed: Nov. 14, 2012

(86) PCT No.: PCT/EP2012/072632
§ 371 (c)(1),
(2) Date: May 15, 2014

(87) PCT Pub. No.: WO2013/072372
PCT Pub. Date: May 23, 2013

(65) Prior Publication Data

US 2014/0299800 A1 Oct. 9, 2014

(30) Foreign Application Priority Data

Nov. 15, 2011 (LU) ..... 91901

(51) Int. Cl.
*F17C 13/04* (2006.01)

(52) U.S. Cl.
CPC ..... *F17C 13/04* (2013.01); *F17C 2205/0329* (2013.01); *F17C 2205/0335* (2013.01); *F17C2223/0123* (2013.01); *F17C 2223/035* (2013.01); *F17C 2223/036* (2013.01); *F17C 2227/048* (2013.01); *Y10T 137/87917* (2015.04); *Y10T 137/88046* (2015.04)

(58) Field of Classification Search
CPC ..... F17C 13/04; F17C 2227/048; F17C 2223/035; F17C 2205/0335; F17C 2205/0329; F17C 2223/036; F17C 2223/0123; Y10T 137/87917; Y10T 137/87891; Y10T 137/88014; Y10T 137/88046; Y10T 137/87121; Y10T 137/87129; Y10T 137/8791; Y10T 137/880468
USPC ..... 137/613, 614.11, 614.12, 614.15, 137/614.19, 637.2, 637.3
See application file for complete search history.

(56) References Cited

U.S. PATENT DOCUMENTS 3,820,560 A 6/1974 Leemann
3,981,328 A * 9/1976 Yonezawa ..... F17C 13/04 137/614.2

(Continued)

FOREIGN PATENT DOCUMENTS

DE 2909046 A1 3/1980
DE 19709096 A1 10/1998
EP 0372279 A1 6/1990

(Continued)

OTHER PUBLICATIONS

International Search Report from corresponding International Application No. PCT/EP2012/072632, mailed Jan. 1, 2013.

*Primary Examiner* — Michael R Reid
(74) *Attorney, Agent, or Firm* — Polster Lieder

(57) ABSTRACT

A tap for a pressurized gas cylinder that includes a body with a gas inlet, a gas outlet, a gas passage connecting the inlet to the outlet, a device for maintaining residual pressure arranged on the gas passage, and a shut-off valve for closing the gas passage, downstream from the device for maintaining residual pressure. A wheel for controlling the tap acts on the shut-off valve and on the device for maintaining residual pressure via control rods. The wheel comprises sliding tracks for the control rods and a first position for filling the cylinder wherein the device for maintaining residual pressure is deactivated and the shut-off valve is open, a second position for closing the cylinder wherein the device for maintaining residual pressure is activated and the shut-off valve is closed, and a third position wherein the device for maintaining residual pressure is activated and the shut-off valve is open.

16 Claims, 2 Drawing Sheets

(56) References Cited

U.S. PATENT DOCUMENTS

| | | | |
|---|---|---|---|
| 4,402,340 | A | 9/1983 | Lockwood, Jr. |
| 5,048,565 | A | 9/1991 | Oi |

FOREIGN PATENT DOCUMENTS

| | | | |
|---|---|---|---|
| EP | 0708281 | A1 | 4/1996 |
| FR | 2657668 | A1 | 8/1991 |

* cited by examiner

GAS CYLINDER WITH HAND WHEEL FOR ACTUATING A RESIDUAL PRESSURE VALVE AND A SHUT-OFF VALVE

CROSS-REFERENCE TO RELATED APPLICATIONS

The present invention is the US national stage under 35 U.S.C. §371 of International Application No. PCT/EP2012/072632, which was filed on Nov. 14 2012 and which claims the priority of application LU 91901 filed on Nov. 15, 2011 the content of which (text, drawings and claims) are incorporated here by reference in its entirety.

FIELD

The invention relates in particular to a tap for a gas cylinder, in particular a tap for such gas cylinder equipped with a function of holding a residual pressure.

BACKGROUND

Valves for gas cylinder valves are now commonly equipped with a residual pressure device. The residual pressure is typically of the order of a few bars (for example 3 bars or 44 psi). This device prevents the penetration of impurities by potential reflux in the bottles in use, or by contact with the atmosphere in the bottles which are not connected and where the valve remains open.

This type of device usually consists of a calibrated check valve arranged upstream of a shut-off valve. This check valve is arranged so that resilient means exert a closing force, the valve being configured such that the high pressure inside the bottle readily pushes the valve to open when there is a flow rate demand. When stopping the flow, the valve closes, preventing reflux. When the bottle is nearly empty so that the pressure within it is lower than the setting pressure required to open the valve, no gas can be withdrawn. With the valve remaining permanently closed, the content of the bottle remains isolated from the outside even when the shut-off valve is open.

When filling the gas cylinder via the tap, the residual pressure device, by its construction, will naturally remain closed. It is therefore necessary to force it open to allow filling of the bottle.

Patent document U.S. Pat. No. 5,048,565 discloses a tap for a gas cylinder, provided with a closing valve, a residual pressure device and a safety valve. The residual pressure device can be actuated in the open position for filling via an opening device controlled pneumatically or mechanically (e.g. via a lever or external tool).

Patent document EP 0372279 A1 discloses a residual pressure device which can be brought into the open position by rotation of an actuating member according to a quarter turn. The valve and the actuating member are equipped with a cam device for converting the rotational movement of the actuating member into a translation movement of the valve.

The actuation for opening a residual pressure device as disclosed in the two above mentioned documents is in principle reserved for qualified personnel to fill bottles. It is indeed important that the device cannot be opened outside of the filling operations. The opening of the device requires a special procedure such as a connection to auxiliary compressed air or as the intervention of special tools.

Patent document U.S. Pat. No. 3,820,560 discloses a scuba bottle tap comprising a residual pressure device with a control lever. The latter is rotatable and acts on a shaft provided with cam profiles acting on a corresponding piece itself acting on the movable part of the residual pressure device. The actuating lever is used to force the device in its open position. It should be noted that the device has a movable seat which allows the filling of the bottle without opening the device with the lever. While the lever allows easy opening of the device, no security is provided to prevent opening of the device when the bottle is in use. The tap of this teaching is foreseen to provide a reserve supply of oxygen during diving. When the actuating lever is designed to give access to this reserve.

The technical problem to be solved by the invention is to provide a tap for a gas cylinder fitted with a residual pressure device and whose filling operation is facilitated.

SUMMARY

The invention relates to a tap for pressurized gas, particularly for a gas cylinder, comprising: a body with an inlet, an outlet and a passage connecting the inlet with the outlet; a device for maintaining a residual pressure at the inlet when the tap is in use, the device being disposed in the passage between the inlet and the outlet; a rotatable actuator disposed on the body, configured to control the forced opening of the residual pressure device in order to deactivate it; wherein the valve further comprises: an auxiliary device distinct of the residual pressure device; and the rotatable actuator comprises at least one track configured so that the rotation of the actuator controls the residual pressure device and the auxiliary device.

The residual pressure device is active when residual pressure ensures its function of maintaining a residual pressure. In the presence of a service flow, it is open. When there is no flow but a sufficient pressure in the cylinder, it can be either open or closed, depending on its construction. It is inactive when it is forced open.

The tap can be dimensioned for a gas pressure of more than 50 bars, more particularly of more than 100 bars.

According to various advantageous embodiments of the invention, the rotatable actuator is generally disc-shaped, and is preferably disposed outside the body.

The rotatable actuator can be made of plastic. The body and/or the rotatable actuator can include indexing means.

The body and/or the rotatable actuator can comprise blocking means to a particular position such as the filling position.

According to other advantageous embodiments of the invention, the body comprises a circular groove on which the rotatable actuator is clipped.

According to yet other advantageous embodiments of the invention, the auxiliary device is a device for shutting-off the passage, preferably disposed downstream of the residual pressure device.

According to yet other advantageous embodiments of the invention, the rotatable actuator comprises a first position for filling the cylinder where the residual pressure device is forced open (that is to say is disabled), and preferably the shut-off device is opened; a second position corresponding to shutting-off the cylinder where the residual pressure device is active and the shut-off device is closed; a third operating position in which the residual pressure device is active and the shut-off device is open; the first, second and third positions being preferably consecutive relative to the rotation of the rotatable actuator.

According to yet other advantageous embodiments of the invention, the rotatable actuator comprises a first track for controlling the residual pressure device and a second track for controlling the auxiliary device, the first track and/or the second track preferably having recesses corresponding to stop positions and configured to generate at the level of the rotatable actuator felt stop positions.

According to yet other advantageous embodiments of the invention, the residual pressure device and the auxiliary device each comprise an element movable in translation in directions at least substantially parallel, the rotatable actuator being rotatable about an axis of rotation at least substantially parallel to these directions.

According to yet other advantageous embodiments of the invention, the tap body includes an inlet gas fitting with a main axis, and a longitudinal axis generally parallel to the main axis of said fitting, the directions of translation of mobile elements of the residual pressure device and of the auxiliary device being at least substantially perpendicular to said longitudinal axis.

According to yet other advantageous embodiments of the invention, the tap comprises a first rod for controlling the residual pressure device, cooperating with the track or one of the tracks of the rotatable actuator.

According to yet other advantageous embodiments of the invention, the tap comprises a second rod for controlling the auxiliary device and cooperating with a track or one of the tracks of the rotatable actuator, the second rod being disposed at least substantially parallel to the first rod.

Advantageously, the first and second rods are disposed on either side of an axis of rotation of the rotatable actuator.

According to yet other advantageous embodiments of the invention, the auxiliary device comprises a shutter cooperating with a seat and normally in contact with said seat by elastic means in a direction corresponding to that of gas when the tap is in service, the second control rod being configured to move the shutter in a direction opposite to the direction of the force exerted by the elastic means.

According to yet other advantageous embodiments of the invention, the first and/or second control rod comprise, each, an abutment limiting its movement in the opposite direction to the direction of control.

According to yet other advantageous embodiments of the invention, the first and/or the second control rod comprise, each, a contact portion with the track or one of the control tracks of the rotatable actuator, the contact portion or the contact portions normally projecting from the body.

According to yet other advantageous embodiments of the invention, the residual pressure device comprises a shutter cooperating with the preferably fixed seat, and normally placed in contact with said seat by elastic means in a direction corresponding to that of gas when the tap is in operation.

According to yet other advantageous embodiments of the invention, the shutter includes a first portion cooperating with the seat and having a first section and a second portion of a second section that is greater than the first section, the first and second portions defining with the body a first high-pressure chamber in contact with the tap inlet, the second portion including sealing means cooperating with a corresponding surface.

According to yet other advantageous embodiments of the invention, the second portion of the shutter defines with the body a second chamber in contact with the passage in the body downstream of the first portion and the seat via a channel of the shutter.

The measures of the invention have the advantage of providing a control of the residual pressure device coordinated with an auxiliary device such as a shut-off valve. Thus, the residual pressure device can remain normally closed during normal operation of the tap (provided that the residual pressure device opens automatically when there is a demand for gas flow). In addition, the construction is very simple and easy to implement.

DRAWINGS

DETAILED DESCRIPTION

Figure 1:
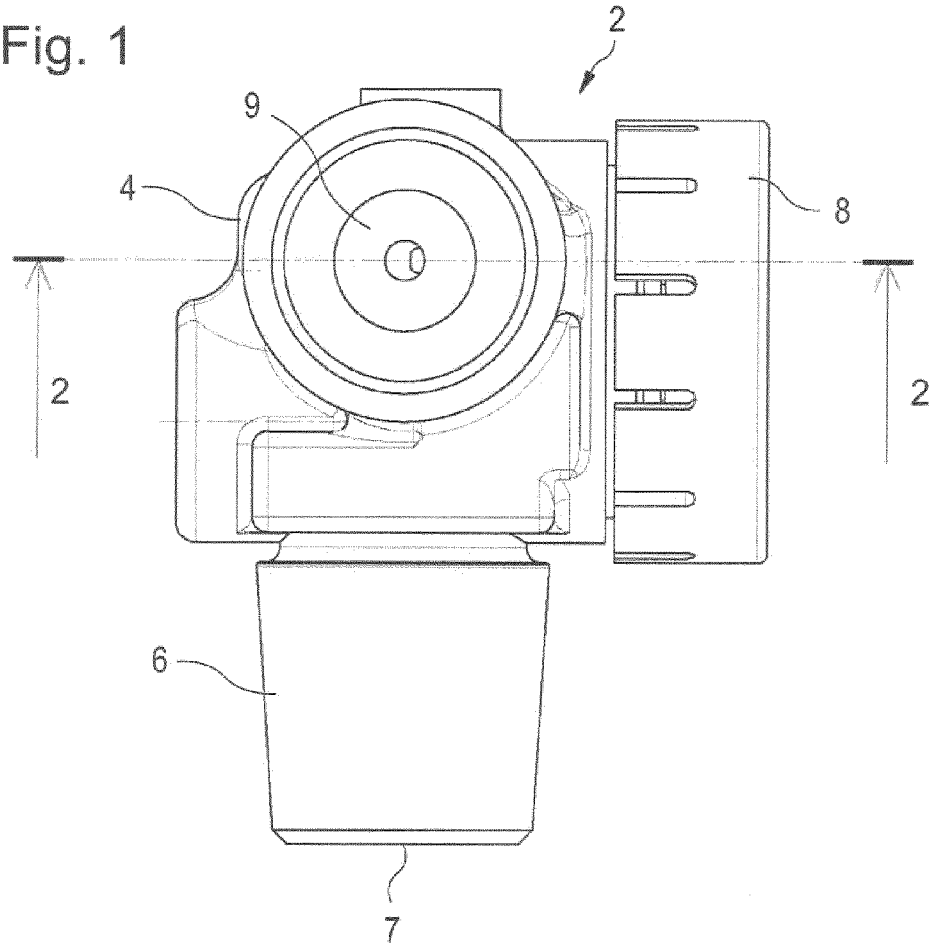
FIG. 1 is a view in plan of a gas cylinder tap, according to various embodiments of the invention.

FIG. 1 illustrates a tap for a gas cylinder according to the invention. Tap 2 includes a body 4, preferably generally massive. The body 4 comprises a connection nipple or fitting 6 to a gas cylinder (not shown). This fitting is in the form of tapered male thread and corresponds to a gas inlet 7 of the tap. The body 4 also comprises a gas outlet 9. The tap is provided with an actuating wheel 8 arranged laterally on the body 4. This wheel is a wheel actuating a residual pressure device and a shut-off device of the tap.

Figure 2:
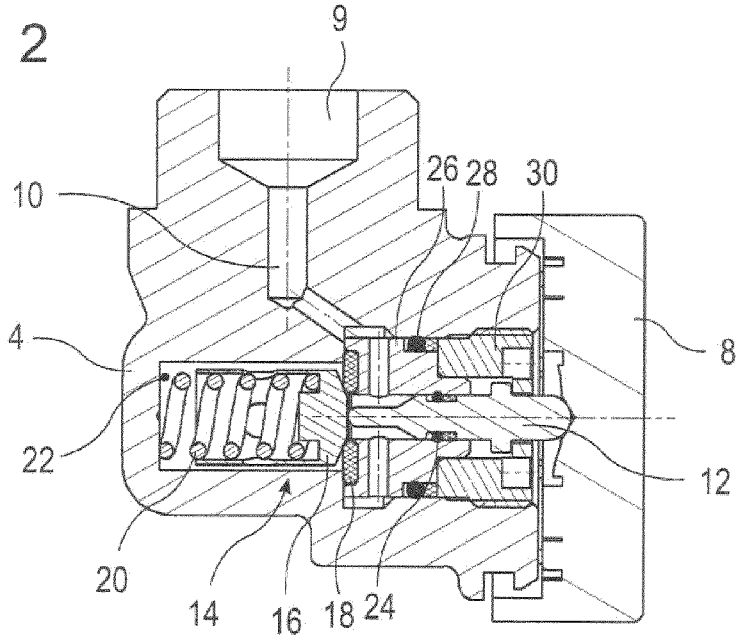
FIG. 2 is a sectional view of the tap of FIG. 1 along the axis 2-2, according to various embodiments of the invention.
Figure 3:
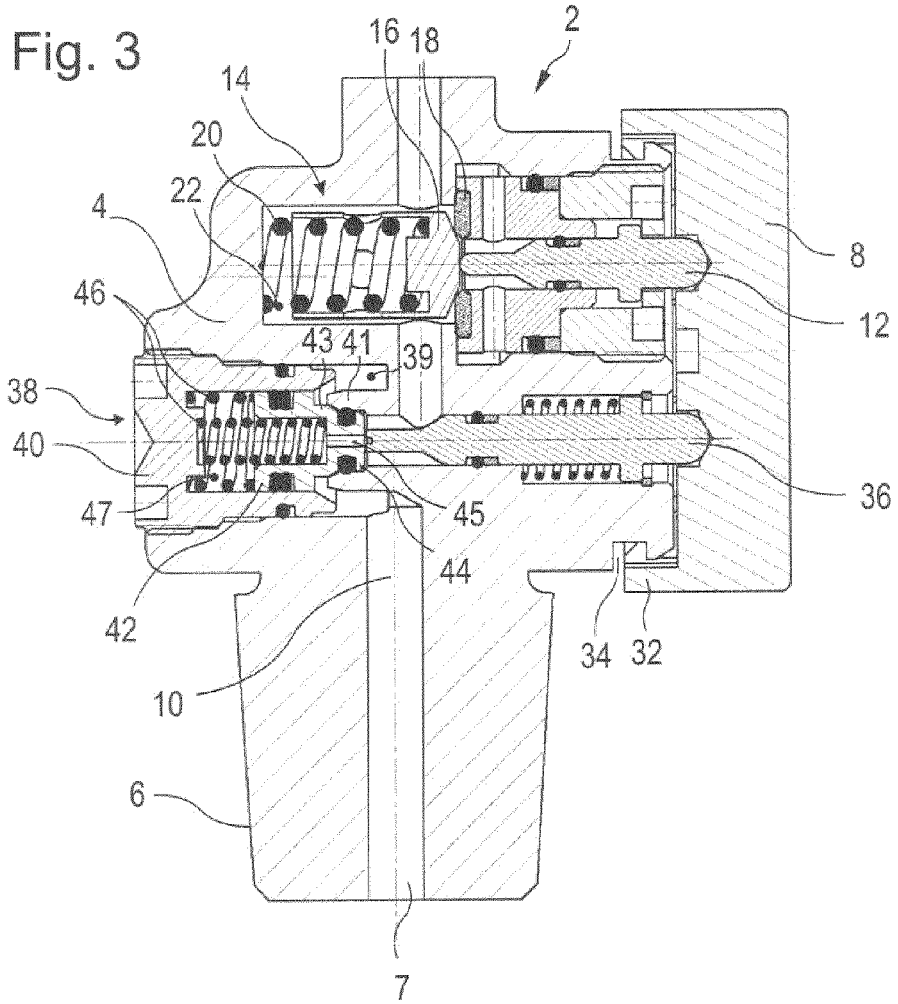
FIG. 3 is a longitudinal sectional view of the tap of FIG. 1, according to various embodiments of the invention.

FIG. 2 which is a sectional view along line 2-2 of FIG. 1, illustrates the interior of the upper tap. As shown in FIG. 2, the body houses a valve 14 for closing the passage 10 connecting the gas inlet (FIG. 1, reference 7) with the outlet 9. The body comprises a chamber 22 connected to the inlet 7 (FIG. 1) via a residual pressure device (FIG. 3, reference 38). The chamber 22 contains a shutter 16 kept pressed against a seat 18 by a spring 20. Spring 20 rests on the bottom of the chamber 22. The seat 18 consists of a washer with a central hole, in a material that is suitable for providing a tight contact with the shutter 16. This latter can be made of metallic material and the seat 18 may be of plastics material such as e.g. nylon. The seat 18 is sandwiched between a shoulder formed in the body 4 and a valve seat carrier 26 held under pressure against the shoulder by a clamping member 30 screwed into a cavity of the body 4. A seal 28 as well as optionally an anti-extrusion ring are provided between the seat carrier 26 and its housing in the body 4. This is a static seal, since the seat carrier 26 is stationary. The seat carrier 26 comprises a central bore extending along its principal axis. This bore houses a control rod 12 of the shutter 16 of the valve 14. The control rod 12 includes a groove with a seal 24, and optionally an anti-extrusion ring so as to seal with the bore of the seat carrier 26 wherein it is housed. Sealing is dynamic because the control rod is able to move in translation along its main axis. It also includes a shoulder adapted to abut against a corresponding shoulder of the clamping member 30. A first end (to the left according to FIG. 2) is in front of the shutter 16 and a second end (to the right according to FIG. 2) is out of the body 4 of the tap and cooperates with a shaped surface of the wheel 8.

The valve 14 is configured so that the shutter 16 is disposed on the upstream side of the seat 18 and the spring 20 normally maintains the shutter under pressure against the seat 18. Thus, the valve 14 normally closes and the cylinder pressure also exerts pressure on the shutter 16 facing the seat 18. As will be explained in more detail in connection with FIGS. 3 and 4, the rotation of the actuating wheel 8 in order to open the valve 14 will move the control rod 12 towards the shutter 16 so as to move it away from its seat 18 and allow the passage of gas from the chamber 22 to the outlet 9. In the closed position of the valve, corresponding to that shown in 2, the control rod 12 is not brought in pressure between the contoured surface of the actuating wheel 8 and the front face of the shutter 16, so as to ensure a satisfactory seal and to allow the packing or caulking of the seat depending on the pressure and the number of cycles and/or age of the valve. In other words, in the closed position of the valve 14, the control rod 12 has at least one of its ends at a distance from its respective contact surface with an appropriate mechanical clearance.

FIG. 3 which is a longitudinal sectional view of the tap of FIG. 1 illustrates the inside of the tap. The passage 10 formed in the body 4 connects the inlet 7 to the outlet (not visible in this Figure but in FIG. 2, reference 9). The passage 10 opening upwardly of the tap body is in direct communication with the chamber containing the valve 14. It can be intended to be connected to a manometer. It is noted that the tap illustrated in FIGS. 1 to 3 is incomplete at its upper part.

The body 4 contains a device for maintaining residual pressure 38 in the cylinder. This device is disposed at the passage 10 connecting the inlet 7 to the outlet 9 of the tap, upstream of the valve 14. It essentially comprises a shutter 43 cooperating with a seat 41, similar to valve 14 with the important difference however that the shutter 43 defines a first chamber 39 with a variably volume, upstream of the seat 41. The shutter 43 comprises a first portion 44 cooperating with the seat 41 of the tap body 4, and a second portion 42 sealingly slidable with a wall of the body 4. This wall can be formed by an insert piece 40 in a bore of the body, as illustrated in FIG. 3. The second portion 42 has a section that is greater than the section of the first portion 44, allowing during the application of pressure from the cylinder to generate a resultant force on the shutter 43 directed to the second portion 42. This force is opposed to the force of the spring or springs 46 arranged between the screwed part 40 and the face of the shutter 43 that corresponds to the second portion 42. The elastic force of the springs 46 and the difference in section between the first and second portions are sized to permit movement of the shutter 43 and thus opening of the gas passage from a given pressure. This minimal pressure for opening the residual pressure device can be in the order of a few bars, for example 3 bars. This pressure corresponds to the residual pressure that will be in the cylinder when the content thereof has been consumed and the cylinder does not supply gas anymore.

A channel 45 formed in the shutter 43 connects a second chamber 39 with the gas passage 10 immediately downstream of the shutter 43. The second chamber 39 is defined by the housing of the shutter 43 and its rear face corresponding to the second portion 42. If someone tries to fill the cylinder without first opening the residual pressure device, the filling pressure will build in the chamber 39 which has an effective section corresponding to the second portion 42 of the shutter 43, said section being higher than the one of the first portion 44. This then results in a force on the shutter oriented in the direction of closure of the latter.

A control rod 36 is partially disposed in the gas passage 10 immediately downstream of the seat 41 and the shutter 43 of the residual pressure device 38. This control rod is similar to the control rod 12 of the valve 14. It is slidably mounted in a bore of the body 4, parallel to the control rod 12. It also has a shoulder intended to cooperate with a corresponding shoulder of the body 4, so as to limit its movement in the direction of closing the residual pressure device 38. A spring is also provided to assist the displacement of the rod 36 towards the actuating wheel 8. Sealing means such as a seal, possibly with an anti-extrusion ring, are provided in a groove of the control rod 36, so as to provide a seal with the bore of the body 4. A first end of the control rod 36 is in facing relation with the first portion 44 of the shutter 43 and a second end is in contact with a profile surface of the wheel 8. Similarly to the valve 14, the control rod is sized to allow the device to let the residual pressure device work correctly despite possible matting of the contact surfaces between the seat 41 and the shutter 43. For this purpose, a mechanical clearance is provided between the first end (the left according to FIG. 3) of the control rod 36 and the shutter 43 when the actuating wheel is in a position not acting on the residual pressure device. The mechanical clearance can be between 0.1 mm and 2 mm, preferably between 0.1 and 1 mm, more preferably between 0.1 and 0.5 mm.

Figure 4:
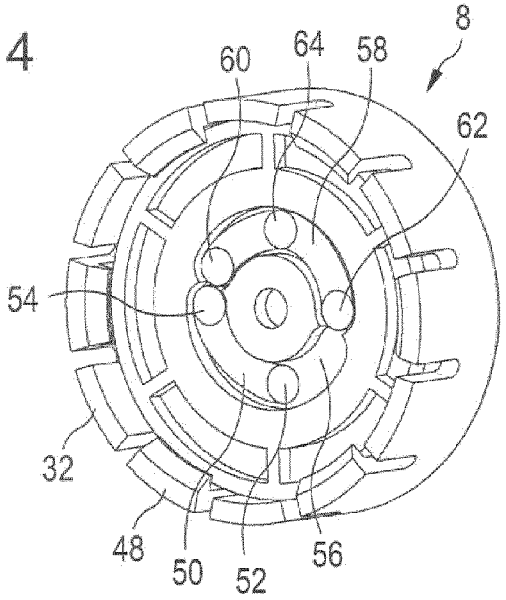
FIG. 4 is an isometric view of the actuating wheel of FIGS. 1 to 3, according to various embodiments of the invention.

As shown in FIG. 4 illustrating the wheel 8 in perspective, this latter comprises a main disc-shaped portion and a skirt formed by a series of sections 32 and 48 some of which 48 are provided with a hook-shaped portion intended to cooperate with a groove 34 (FIG. 3) formed on the body 2.

The inner face of the disc-shaped portion of the wheel 8 comprises two tracks. A first track 50 is intended to cooperate with the control rod 36 of the residual pressure device. It comprises a sliding surface for the corresponding end of the control rod 36, the sliding surface having an inclined profile so as to move the control rod upon rotation of the wheel 8. The first track 50 includes two recesses or rest points for the corresponding end of the control rod 36.

A first recess 52 corresponds to a first position of the control rod where it does not control the residual pressure device. This corresponds to a first portion of the track profile where the profile is the lowest or most distant from the tap body. A second recess 54 corresponds to a second position of the control rod 36 where it causes the opening of the residual pressure device. The second recess corresponds to a portion of the track where the profile is the highest or nearest to the body of the tap.

The first track 50 also includes a clearance zone 56 extending the track from the first recess 52. This clearance shall be designed not to move the corresponding control rod.

A second track 58 is intended to cooperate with the control rod 12 of the valve 14. Similarly to the first track, the second track 58 comprises a sliding surface for the corresponding end of the control rod 12, this surface slide having an inclined profile so as to move the control rod 12 upon rotation of the wheel 8. It comprises three recesses or resting points for the corresponding end of the control rod 12. A first recess 64 disposed at a central portion of the track forming a lowermost portion of the track. The first recess corresponds to a position of the wheel where the tap is not operated, that is to say is normally closed. A second recess 60 and a third recess 62 are arranged, respectively, at the ends of the track 58. These end portions correspond to portions that are high or close to the tap body. The second and third recesses correspond to positions of the wheel where the tap is actuated, that is to say is set to the open state.

The first recess 52 of the first track 50 and the first recess 64 of the second path correspond to a closed position of the tap, that is to say a position where the valve and the residual pressure device are normally closed. In the case of illustrations of FIGS. 1 to 4, the control rods 12 and 36 are diametrically opposed with respect to the center of rotation of the wheel 8, so that the first recesses 52 and 64 of first and second tracks are also diametrically opposite.

The second recess 54 of the first track 50 and the third recess 62 of the second track 58 correspond to a position of filling the cylinder. Indeed, the second recess 54 of the first track 50 will force the opening of the residual pressure device and the third recess 62 of the second track 58 provides opening of the valve 14. It is to be mentioned that opening of the valve 14 is normally not necessary given its construction in the form of a check or pressure valve that can be opened with the filled pressure. As shown in FIGS. 2 and 3, the closing spring 20 of the shutter 16 of the valve 14 is powerful enough to ensure a particular level of security and satisfactory sealing for the valve. The pressure and hence the flow rate resulting therefrom, of the gas exiting the tap during filling would be substantially reduced when passing through the valve 14 in the absence of a forced opening of this latter. This is why a valve opening 14 is provided at the filling of the cylinder.

The second recess 60 of the second track 58 and the clearance 56 of the first track 50 corresponding to an operating position of the tap. In fact, the second recess 60 provides a displacement of the control rod of the valve forcing its opening while the clearance area 56 of the first track 50 ensures an undisturbed operation of the residual pressure device.

The first and second tracks are concentric and describe each, about half a circle. In the specific case described in connection with the figures, the two paths have substantially the same radius. They could, however, have different radii. In this case, the tracks could describe more than a semicircle. The positioning of the control rods of the valve and the residual pressure on each sides of the center of rotation of the wheel 8 allows a balancing of the pressures exerted by the rods on the steering wheel. It is however possible to provide that the control rods are arranged in a lower area at 180°, specifically 90° or even aligned on a radius.

It is also to be noted that the presence of recesses on the track(s) of the wheel is not mandatory. It ensures resting positions with a felt sensation when manually operating the actuating wheel. We can also provide separate indexing means for the wheel and one or more continuous tracks without abrupt change in profile at resting points.

The actuating wheel has therefore three positions:

A first position for filling the cylinder where the residual pressure device is deactivated, that is to say in a forced open position, and the valve is open;

A second position for shutting-off the cylinder, where the residual pressure device is active and the valve is closed;

A third operating position for operation of the tap in which the residual pressure device is active and the valve is open; the residual pressure device opening in the presence of a sufficient pressure in the cylinder.

The first, second and third positions are consecutive with respect to the rotation of the rotatable actuator.

It should be noted that the tap of the invention is not exclusively intended to be mounted on a gas cylinder. It can in fact be mounted among others on bodies or on conduits of pressurized gas.

LIST OF REFERENCE SIGNS

2: tap
4: body
6: Input connection for bottle inlet to be mounted on a cylinder
7: gas inlet
8: actuating wheel
9: gas outlet
10: gas passage
12: (first) control rod of the valve
14: valve
16: valve shutter
18 seat
20: valve spring
22: valve chamber
24: seal of the first control rod
26: seat carrier
28: seal
30: clamping member of the seat carrier
32: wheel skirt
34: groove
36: (second) control rod of the residual pressure device
38: residual pressure device
39: first chamber of the residual pressure device
40: screwed part of the device
41: seat of the residual pressure device
42: second portion of the shutter of the residual pressure device
43: shutter of the residual pressure device
44: first portion of the shutter of the residual pressure device
45: channel of the shutter of the residual pressure device
46: spring
47: second chamber of the residual pressure device
48: hook-shaped skirt of the wheel
50: (first) track for the residual pressure device
52: first recess of the first track, in the normally closed position of the residual pressure device
54: second recess of the first track in the open position of the residual pressure device
56: clearance zone of the first track
58: (second) track of the valve
60: second recess of the second track, corresponding to an open valve position
62: third recess of the second track, corresponding to an open valve position
64: first recess of the second track, corresponding to a closed valve position

What is claimed is:

1. A tap for a pressurized gas cylinder, said tap comprising:

a body with an inlet, an outlet and a passage connecting the inlet to the outlet;

a residual pressure device for maintaining a residual pressure at the inlet when the tap is in service, the device being disposed in the passage between the inlet and the outlet;

a rotatable actuator disposed on the body, configured to control a forced opening of the residual pressure device in order to deactivate the device;

an auxiliary device distinct from the residual pressure device, wherein the rotatable actuator comprises at least one track configured so that the rotation of the actuator is structured and operable to control the residual pressure device and the auxiliary device;

a first control rod of the residual pressure device, cooperating with the at least one track of the rotatable actuator; and a second control rod of the auxiliary device, cooperating with the at least one track of the rotatable actuator, the second control rod being disposed at least substantially parallel to the first rod.

2. The tap according to claim 1, wherein the rotatable actuator is generally disc-shaped.

3. The tap according to claim 2, wherein the rotatable actuator is disposed outside the body.

4. The tap according to claim 2, wherein the body comprises a circular groove on which the rotatable actuator is clipped.

5. The tap according to claim 4, wherein the auxiliary device is a device for shutting-off the passage.

6. The according to claim 5, wherein the auxiliary device is disposed downstream of the residual pressure device.

7. The tap according to claim 5, wherein the rotatable actuator comprises:

a first position for filling the cylinder where the residual pressure device is forced to an open position, and the auxiliary device is open;

a second closed position for shutting-off the cylinder where the residual pressure device is active and the auxiliary device is closed; and a third position of service in which the residual pressure device is active and the auxiliary device is open, wherein the first, second and third positions are consecutive relative to the rotation of the rotatable actuator.

8. The tap according to claim 7, wherein the at least one track comprises a first track for controlling the residual pressure device and a second track for controlling the auxiliary device, at least one of the first track and the second track having recesses corresponding to stop positions.

9. The tap according to claim 8, wherein the residual pressure device and the auxiliary device each comprise an element movable in translation in directions at least substantially parallel, the rotatable actuator being rotatable about an axis of rotation at least substantially parallel to these directions.

10. The tap according to claim 9, wherein the tap body comprises a gas inlet fitting with a main axis, and a longitudinal axis generally parallel with the main axis of the fitting, the directions of translation of the movable elements of the residual pressure device and of the auxiliary device being at least substantially perpendicular to said longitudinal axis.

11. The tap according to claim 10, wherein the auxiliary device comprises a shutter cooperating with a seat and normally in contact with the seat by elastic means in a direction corresponding to that of a gas when the tap is in service, the second control rod being configured to move the shutter in a direction opposite to the direction of the force exerted by the elastic means.

12. The tap according to claim 11, wherein at least one of the first and the second control rod comprises an abutment limiting its movement in a direction opposite to a control direction.

13. The tap according to claim 12, wherein at least one of the first and the second control rod comprises a contact portion with at least one of the tracks of the rotatable actuator, the contact portion projecting normally from the body.

14. The tap according to claim 13, wherein the residual pressure device comprises a shutter cooperating with a fixed seat, and normally placed in contact with the fixed seat by an elastic means in a direction corresponding that of the gas when the tap is in service.

15. The tap according to claim 14, wherein the residual pressure shutter comprises a first portion cooperating with the fixed seat and having a first section and a second portion of a second section greater than the first section, the first and second portions defining with the body a high pressure chamber in contact with the tap inlet, the second portion including a sealing means for cooperating with a corresponding surface.

16. The tap according to claim 15, wherein the second portion of the residual pressure shutter with the body defines with the body a second chamber in contact with the passage of the body downstream of the first portion and the fixed seat via a channel of the shutter.

* * * * *